US005720148A

United States Patent [19]

Bedin et al.

[11] Patent Number: 5,720,148

[45] Date of Patent: Feb. 24, 1998

[54] METHOD FOR FILLING BOTTLES, ESPECIALLY PLASTIC BOTTLES, WITH A LIQUID AND AN ASSOCIATED DEVICE

[75] Inventors: Olivier Bedin, Bordeaux; Jean Bedin, Camblanes Et Meynac, both of France

[73] Assignee: DEEP, Societe Civile, Camblanes Et Meynac, France

[21] Appl. No.: 672,981

[22] Filed: Jul. 1, 1996

[30] Foreign Application Priority Data

Jun. 30, 1995 [FR] France ..... 95 08146

[51] Int. Cl.[6] ..... B65B 55/04

[52] U.S. Cl. ..... 53/167; 53/127; 53/510

[58] Field of Search ..... 141/8, 82; 53/111 R, 53/111 RC, 127, 167, 510, 440, 425, 426, 431, 432

[56] References Cited

U.S. PATENT DOCUMENTS

| | | | |
|---|---|---|---|
| 3,559,563 | 2/1971 | Brenner et al. | 53/167 X |
| 3,643,586 | 2/1972 | Robinson | 53/510 |
| 4,347,695 | 9/1982 | Zobel et al. | 53/432 |
| 4,588,000 | 5/1986 | Malin et al. | 53/431 X |
| 4,662,154 | 5/1987 | Hayward | 53/431 |
| 5,033,254 | 7/1991 | Zenger | 53/431 |
| 5,123,229 | 6/1992 | Dardaine et al. | 53/426 |
| 5,178,841 | 1/1993 | Volkins et al. | 53/431 X |
| 5,251,424 | 10/1993 | Zenger et al. | 53/431 |

FOREIGN PATENT DOCUMENTS

| | | |
|---|---|---|
| 0 120 789 | 10/1984 | European Pat. Off. . |
| 2 271 347 | 4/1994 | United Kingdom . |
| 2 280 669 | 2/1995 | United Kingdom . |

*Primary Examiner*—Daniel Moon
*Attorney, Agent, or Firm*—Young & Thompson

[57] ABSTRACT

The invention concerns a device for filling bottles, especially plastic bottles, with a liquid, wherein said device includes an air separation liquid station (12), a flash pasteurization station (14), a station (16) for saturating the liquid with a sterile inert gas with respect to the liquid, a bottle washing station (106) and stoppers with a liquid disinfectant with under hood drying in a treated atmosphere, a bottle filling station (108), preferably by means of gravity filling under a slight partial vacuum, a station (150) for degassing the inert gas, and a stoppering station (152).

8 Claims, 6 Drawing Sheets

METHOD FOR FILLING BOTTLES, ESPECIALLY PLASTIC BOTTLES, WITH A LIQUID AND AN ASSOCIATED DEVICE

FIELD OF THE INVENTION

The present invention concerns a method for filling bottles, especially plastic bottles, with a liquid and more particularly a fruit drink, as well as the associated device.

BACKGROUND OF THE INVENTION

Food liquid are increasingly being packed and in particular fruit drinks in varied containers and in particular in metallic cans whose cover includes an inner capsule provided with said can and equipped with a traction ring allowing for opening and consumption of the liquid.

There are also glass packagings which fully guarantee the preservation of the organoleptic qualities of the liquids contained, but which also authorize the filling of hot-sterilized hot liquids which causes a partial vacuum being produced inside the container when returning to ambient temperature.

Nevertheless, this conditioning does pose problems of recycling as the glass is a hard material and is expensive to melt, unless the bottles are reused directly after cleaning and treatment with a loss of quality as the outer aesthetic aspect is undoubtedly altered.

Furthermore, the hot treatment can modify the initial qualities of liquids and in particular this method requires a large amount of energy be expended for treating the liquid and heating the bottles so as to avoid thermal shocks during filling.

In addition, the plastic bottle allows for a significant gain of weight and a reduction of the risks of cutting with fragments of glass bottles which can easily be broken.

If these containers do generally provide satisfaction, there is nevertheless a search to produce a replacement container able to satisfy the same liquid conservation criteria, especially the preservation of the organoleptic qualities, but one available at a much lower cost price.

The development of plastic containers is mainly oriented towards vinyl polychlorides but especially towards polyethylenes and known as PETs for the remainder of the description.

This material can be produced cheaply, is recyclable and can be integrated as a stage of a filling method by producing in situ containers with a rate matching the filling capacities.

Then there is a problem with the filling method as the temperature-resistant PETs increase the cost price owing to the amount of material required for increasing the thickness of the walls.

Furthermore, for cold filling, the thickness of the wall is reduced which equally reduces the amount of material needed, the cost price and subsequent recycling.

Cold filling does have the definite advantage of eliminating crushing of the bottle which would have been generated by a hot filling. In fact, the cooling which follows hot filling causes a contraction of the gaseous fluid present in the bottle and which is expressed by a warping of the bottle known as <<collapse>>, linked to the fact that the mechanical resistance of the walls is too weak to resist the degression generated by contraction of the gaseous fluid.

On the other hand, if cold filling is able to suppress <<collapse>>, it does pose other problems since extra-clean filling conditions are required and in particular it is essential to overcome the residual problems of crushing of the bottle under the effect of slight variations of temperature and the problems of inflation caused by fermentation rendering the liquid unfit for consumption and which moreover causes the container to inflate.

In order to resolve these various problems, the following parameters need to be looked at:

a/environment, b/operator, c/treatment of the liquid to be bottled, d/bottles, e/stoppers, and f/cleaning and sterilization of the machines.

a/as regards the environment, hoods are produced in white rooms with a class cleanness of 100 as per the American standard FD 209 D, that is atmospheres having a maximum number of 100 particles of 0.5 micrometers per cubic foot, namely 4000 particles for one cubic meter, with laminar flow air circulations which poses constraints to be explained in detail subsequently.

b/for operators, it is proper to define the access procedures. The drawing up of this document recapitulating the instructions and control means is relatively simple and does not form part of the present invention.

c/the treatment of the liquid to ensure its sterilization is also fully known as this concerns an ultrafast pasteurization at a high temperature and known as <<flash pasteurization>> so as to destroy bacteria and any other undesirable microbic fauna without modifying the taste quality of the liquid and preserving the vitamins and other useful elements.

On the other hand, it is advisable to resolve another problem concerning the suppression of the oxygen in the container once it has been closed, this oxygen likely to generate a parasitic fermentation, whilst maintaining in said container a sufficiently controlled pressure so that it possesses a certain rigidity.

The known liquid nitrogen drop method is able to keep the liquid in contact with the liberated gaseous nitrogen, the sealing of the container needing to be effected extremely quickly after introducing the nitrogen drop.

The recourse to carbonic gas is less frequently retained as a rendering inert solution as the carbonic gas acts on the organoleptic qualities of the liquid, especially when it concerns fruit drinks. In addition, being soluble, the effect provoked is contrary to the one sought after as the generated partial vacuum results in the collapse phenomenon.

d/the bottles can be produced on site or produced in a different location and transported and conveyed to the white room with also an ultra-clean treatment.

These known treatments of the prior art use a powerful oxidizing agent, peracetic acid followed by a washing.

There is the possibility of the presence of a slight quantity of acid at the time of filling, which requires that additional precautions be taken. In addition, this oxidizing agent has an action with a time of action which frequently requires an activation by heat.

e/the problem of stoppers, apart from their specific study concerning imperviousness with the bottle, is roughly identical to that of the bottles. From the point of view of treatment a conditioning, it is essential to provide extra-clean conditions.

f/the cleaning of the machines and sterilization are obtained by projecting sterilizing chemical agents or heating the entire machine whose main elements would have been examined for this temperature rise.

As regards the embodiment of the present invention and given by way of non-restrictive example, production does not occur in situ and the stoppers are supplied from other sites with deliveries generally provided under a double packing: the stoppers are in a plastic film bag and these bags are stored in treated cartons.

It is possible to have production on a different site as the storage of these products represents a relatively small volume, contrary to the case with the bottles whose much larger volume requires that a solution be found to produce said bottles on the filling site.

SUMMARY OF THE INVENTION

The aim of the present invention is to provide a method for filling bottles made of PET plastic and able to mitigate the drawbacks of the prior art and in particular to suppress collapse and avoid any fermentation after filling during storage prior to sale and consumption, knowing that the fixed objective is a sale limit date of about several months in accordance with ultra-clean hygienic conditions.

The present invention also concerns the associated device able to implement the various stages of the method.

To this effect, the method for filling plastic bottles with a liquid, in particular a fruit drink, with the aid of a filling carrousel is characterized in that it includes the following stages:

- treatment of the fluid by means of air separation, a flash pasteurization, and an inert gas saturation with respect to said liquid,
- treatment for disinfecting the bottles and stoppers with ozonic water followed by a forced and treated air drying, and
- filling, degassing the dissolved inert gas and stoppering under a treated air laminar flow.

The inert gas is nitrogen for fruit drinks in particular and the treated air is air class 100.

According to another characteristic, the air contained in the bottle is evacuated, filling and leveling being carried out by suction under a slight partial vacuum, the air being evacuated and the sucked up liquid being brought upstream of the treatment circuit.

Furthermore, contact of the liquid with the air is limited.

The present invention also concerns the associated filling device for plastic bottles, wherein it includes:

- a station for separating the air from the liquid,
- a flash pasteurization station,
- a station for saturating the liquid with a gas which is inert with respect to the liquid,
- a station for washing the bottles and stoppers with ozonic water with under hood drying in a treated atmosphere,
- a station for filling the bottles by means of gravity filling under a slight partial vacuum, and
- a stoppering station with degassing of the inert gas.

The air separation station includes a vat with vacuum means.

The liquid saturation station includes a vat pressurized with a neutral gas with respect to the liquid from a source for this gas, in this case being a bottle equipped with a pressure reducing valve, and means for pulverizing the liquid in said tank.

The bottle washing station includes means for projecting ozonic water onto the internal and external walls of the bottles, and treated air laminar flow under hood drying class 100.

The bottles filling station includes a circuit for feeding with a distributor tank, distribution arms, noses functioning under a slight partial vacuum connected to these arms, and a suction circuit independent of the feed circuit.

According to one preferred embodiment of the invention, the distributor tank has a small capacity and thus small dimensions and the distribution arms are mounted radiating so as to disturb the laminar flow as little as possible.

This distributor tank also includes a liquid admission intake fitted with a sterile air intake, that is a class 100 intake, so as to allow for flow by means of gravity, and an obturation control able to preserve a constant level in this tank and limit exchanges of the liquid with the air.

BRIEF DESCRIPTION OF THE DRAWINGS

The method of the invention is described in strict relation to the associated device, this description being drawn up with reference to the accompanying drawings on which.

DETAILED DESCRIPTION OF THE PREFERRED EMBODIMENTS

Figure 1:
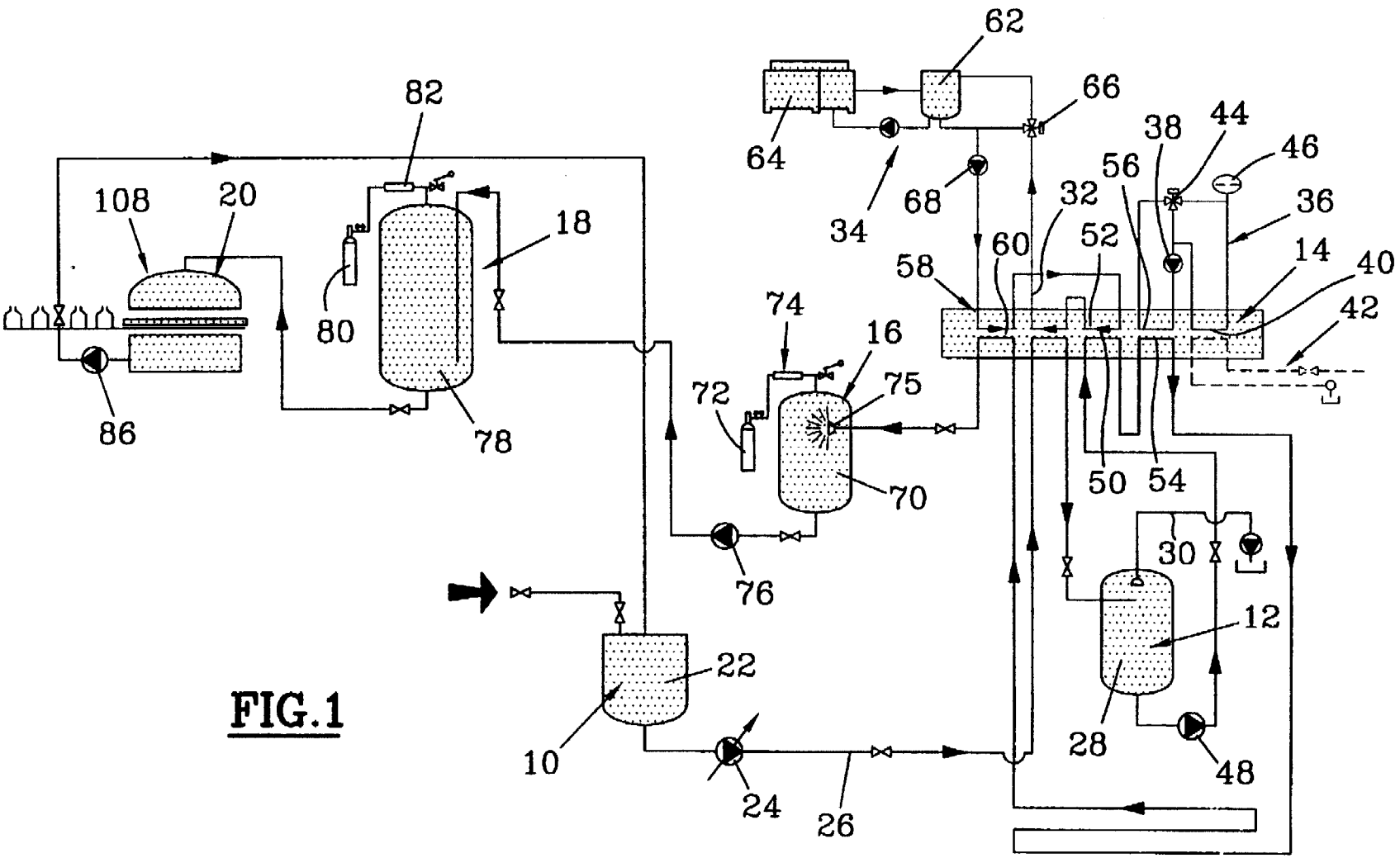
FIG. 1 is a diagrammatic view of the entire device with the various stages of the method.

FIG. 1 shows the inlet buffer storage 10, the air separator 12, the flash pasteurization loop 14, the saturator 16, the buffer storage 18 and the filling station 20.

The description of the fluid circuit has been simplified so as to better understand the invention, but in reality is much more complex, especially if instrumentation and bypass circuits are added.

At its inlet, the buffer storage 10 includes a vat 22 able to accumulate the liquid, in this case a fruit drink, so as to be able to absorb feeding discontinuities whilst regulating its flow through the liquid treatment circuit.

For the purpose of simplification, the fruit drink is a composition of water, and a fruit and sugar concentrate with possibly preserving agents.

The liquid is propelled by a pump 24 into the circuit portion 26 which routes it to the air separator 12. This air separator includes a vat 28 with means 30 for placing the vat in a partial vacuum so as to lower the oxygen rate.

In fact, the oxygen content is considerable at the juice production outlet as reconstitution is carried out under high agitation and according to the method needs to reach a rate<1 mg/l of oxygen so as to take account of any possible subsequent picking up of oxygen during some of the following filling stages.

It is to be noted that the liquid is pre-cooled before entering the air separator via a loop 32 of the cold unit 34 of the flash pasteurization.

This flash pasteurization further includes a hot unit 36 with a circulation pump 38, a loop 40 for exchange with a vapor unit 42. A three-channel valve 44 is able to adjust the temperature, whereas an expansion vase 46 compensates the cubic expansion of the fluids.

The liquid put into circulation by a pump 48 first of all passes through an exchanger 50 with a cold loop 52 at the outlet of the air separator and then immediately afterwards through an exchanger 54 with a hot loop 56 so as to treat the liquid by the heat for a short period and finally through an exchanger 58 with an extremely cold loop 60 at the immediate outlet of the cold production unit so as to bring the liquid back to ambient temperature.

The cold unit 34 in fact includes a buffer tank 62 with cold water cooled by a cold recirculation loop 64. A three-channel temperature adjustment valve 66 and a recirculation pump 68 complete the cold unit.

After cooling, the liquid is pulverized at the top of a vat 70 of the saturator 16 by pulverization means 75. This vat is placed on excess pressure of nitrogen derived from a storage bottle 72 with a pressure reducing system 74. The liquid saturates in nitrogen.

This saturation pressure and the temperature of the liquid are established according to the stiffness to be obtained for the bottle after it has been filled and closing with the stopper, this stiffness being generated by the internal counter-pressure. The parameters to be taken into account are also the transport and storage conditions, the consumption conditions, the sea or altitude level, and the consumption temperature, that is ambient or fresh.

A circulation pump 76 transfers the saturated liquid into a buffer tank 78 subjected to an excess pressure of nitrogen by means of a bottle 80 and a pressure reducing valve system 82 so as to maintain the previously established degree of saturation.

The liquid is then ready to be drawn off for filling with the aid of a carrousel 108, all the filling means being defined hereafter.

An ultimate circulation pump 86 reroutes the excess liquid, possibly not bottled, towards the starting point of the device into the tank 22 of the inlet buffer storage.

In actual fact, the diagrammatic circuit needs to be produced according to the relevant requirements in this particular field by limiting bends and more generally all the elements likely to provoke turbulences or air accumulations prohibiting a satisfactory draining. This installation and the corresponding recommendations do not form part of the present invention.

Figure 2:
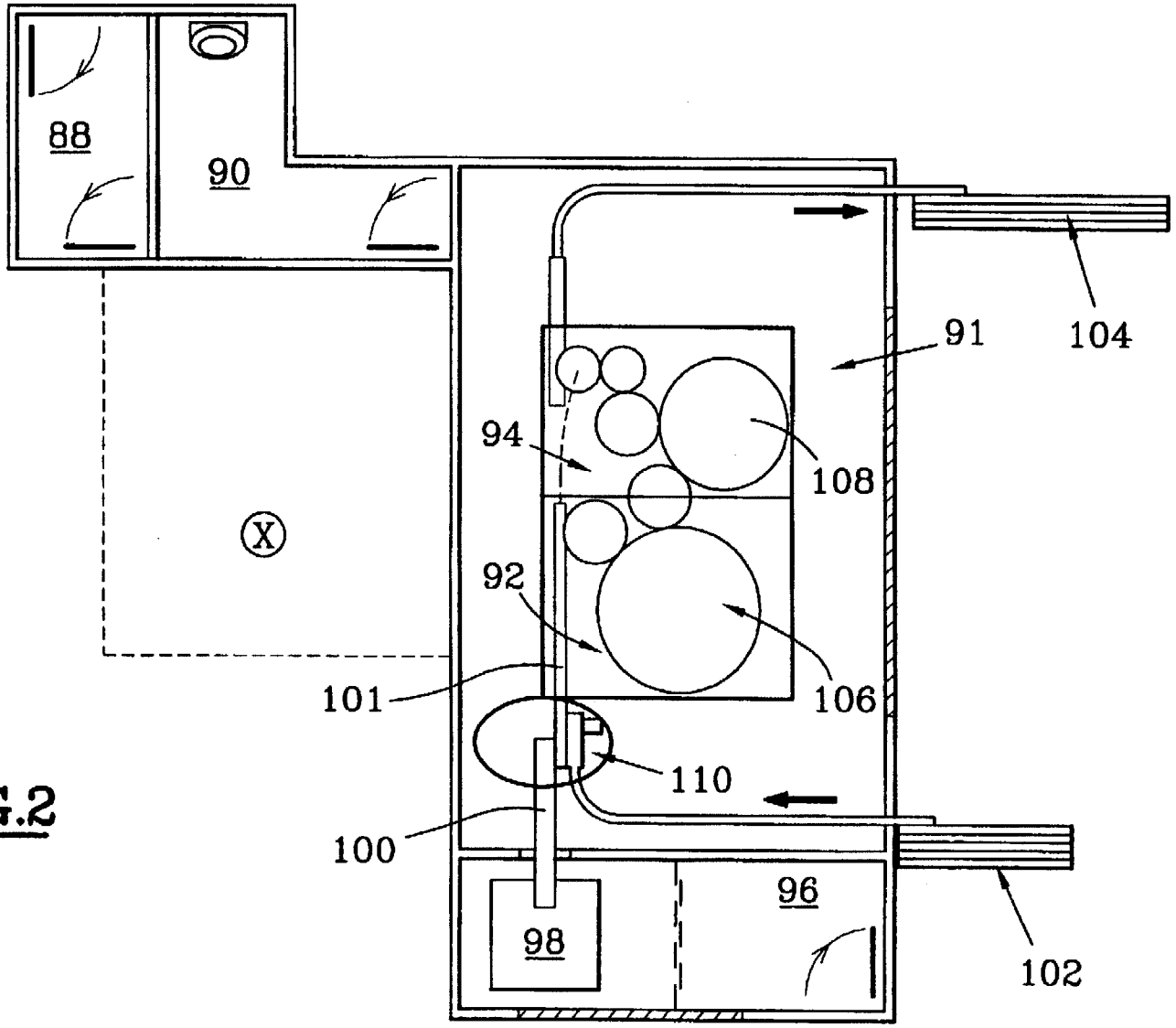
FIG. 2 is a view of the flows of operators and those of the products at the time of treatments of the bottles and stoppers, as well as the various filling carrousels with the hoods.

FIG. 2 shows the circulation of operators at the bottle and stopper supply point, as well as the various transfer and filling carrousels.

The fluid system described above is integrated at X on FIG. 2.

The lock chambers 88 and 90 enable operators to change clothes before entering the white room 91.

This room is a class 10,000 room as per the standard indicated earlier in the text and has a turbulent flow.

The carrousels are disposed at the center of this room under two hoods 92, 94, the hood 94 being a class 100 hood, with a laminar flow circulation.

An annexed room 96 allows for transfer of the stoppers by means of a known type of distributor with an elevator 98 and an intake 100 of said stoppers, followed by a rotary bowl 110 able to position the stoppers in the feed and treatment ramp 101.

The empty bottles are supplied at 102 and filled at 104.

The hood 92 covers a bottle preparation station 106 and the stopper treatment zone and the hood 94 covers the stoppering/filling station 108.

Figure 4:
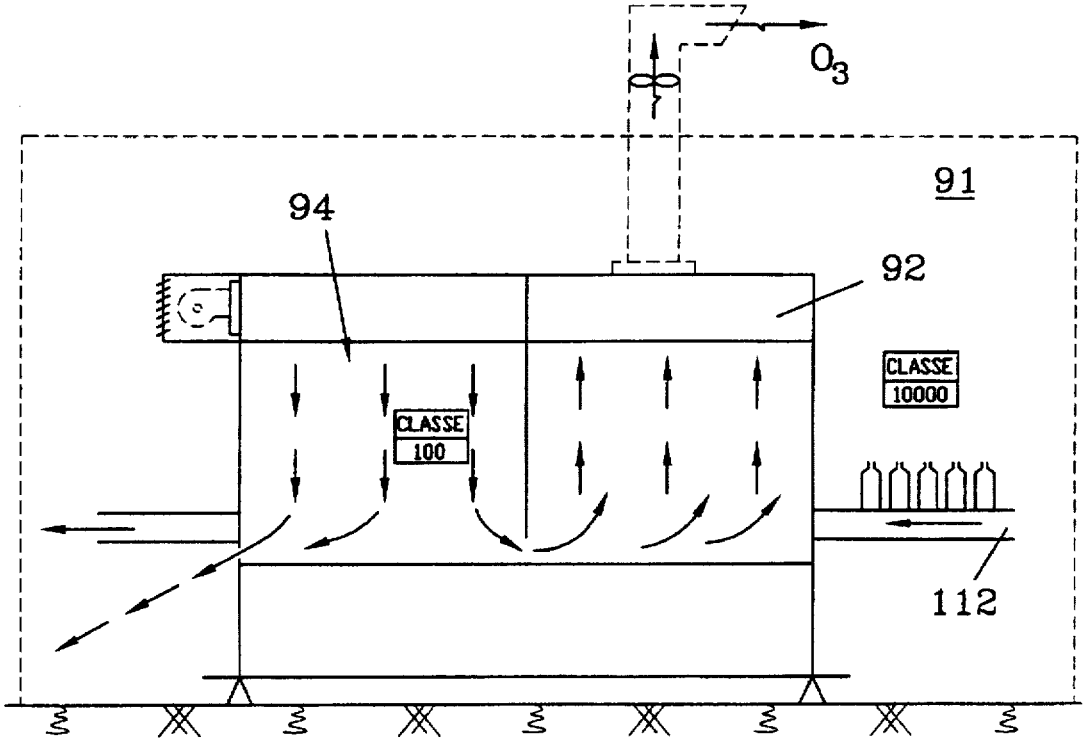
FIG. 4 is another view of the hoods.

FIG. 4 shows the cleanness degrees and the circulation of flows.

Concerning filling which is the most sensitive zone, the hood 94 is fed with class 10,000 air which passes through bacterial filters so as to obtain an adapted class 100 air quality, this air diffusing at the outlet directly onto the frame of the machine so as to avoid shadow zones so as to be then distributed firstly in the room via small openings, and secondly into the hood 92 concerning bottle preparation.

Figure 3:
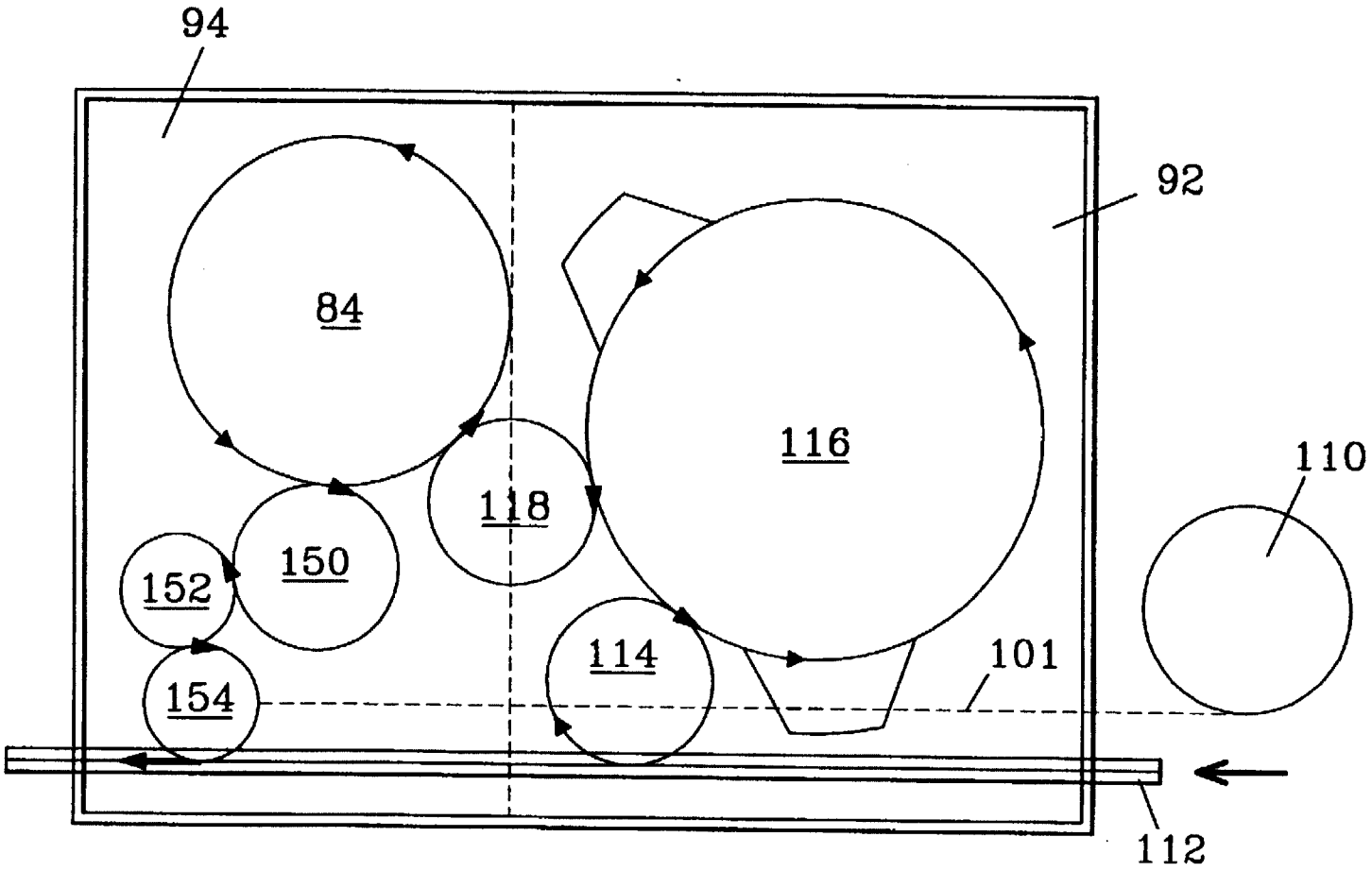
FIG. 3 is a detailed view of the hoods.

Reference could be made to FIG. 3 for details of the bottle preparation and prepared filling stations.

A conveyor 112 transports the empty bottles so as to feed a carrousel 116 by means of a transfer star 114. It is during this stage that the bottle is prepared by means of a treatment with ozonic water as a disinfectant agent. This water is prepared in a well known commercially-available separate production system and is not described in the present description.

The choice of ozonic water in this specific case is particularly advisable as it concerns an extremely powerful oxidizing agent which reacts in an aqueous solution with the elements of the cellular walls, which constitutes a gauge for complete disinfection. Furthermore, the ozone is eliminated extremely quickly by evaporating into the air, at least with periods compatible with the high bottle passage rates.

The concentrations and contact times need to be carefully determined according to the sanitary conditions of the product, namely the bottle delivered or produced on site.

In addition, the carrousel is scavenged with air which requires that the disposition of the carrousel needs to be studied so as to be as transparent as possible to the air flows so as to generate disturbances as little as possible.

The flow of air circulates from bottom to top as the bottles are rinsed internally and eternally and then turned upside down so as to ensure the draining of the contained ozonic air.

It is at this stage that the air flow ensures the vaporization of the residual ozone, but if water exists, it can only act on fully neutral water. The ozone is evacuated via suction under the hood.

The bottle rinsing devices are well known and are thus not described here in detail.

A star 118 ensures the picking up of the treated bottles towards the filling carrousel 108. The upper portion of this carrousel is shown in detail on FIG. 5.

The carrousel includes a small capacity distributor tank 120 with a mounting of star filling arms 122, the extremity of each of the arms bearing a filling nose 124, the functioning of these noses being shown subsequently.

These noses are slight partial vacuum type noses and pipes 126 are provided for sucking up excess liquid for equaling the levels. These pipes are branched T on a collecting ring 128 supported by radiating supports 130. The reference 131 denotes an evacuation of the sucked up liquid during leveling and the liquid is brought into the inlet buffer tank 22 (FIG. 1).

The distributor tank 120 is fed by a liquid intake 132 fitted with a partial depression air intake 134 to permit flowing via gravity.

The considerable transparency of this disposition to the laminar air flows, which can be checked by smoke tests or an anemometrical measurement with a laser, thus ensures good scavenging without any shadow zone and by disturbing as little as possible the sliding of the layers with respect to one another.

The noses are well known and the disposition and functioning is described with reference to FIGS. 6A to 6C.

Each nose can be dismantled to allow for cleaning and includes a reduced number of elements. The nose is formed of a ring 136 housing a funnel-shaped membrane 138 made of a flexible material such as silicon, and a mobile head 140 connected to this funnel. This head can assume two positions, namely one in which it seals off the flow openings 142, and a position in which it frees said flow openings. A joint 144 provided to cooperate imperviously with the opening of the neck of the bottle also ensures the picking up of the mechanical supports of said neck on the head since, as shall be described subsequently, it is the bottle which moves and the nose which remains fixed.

Figure 5:
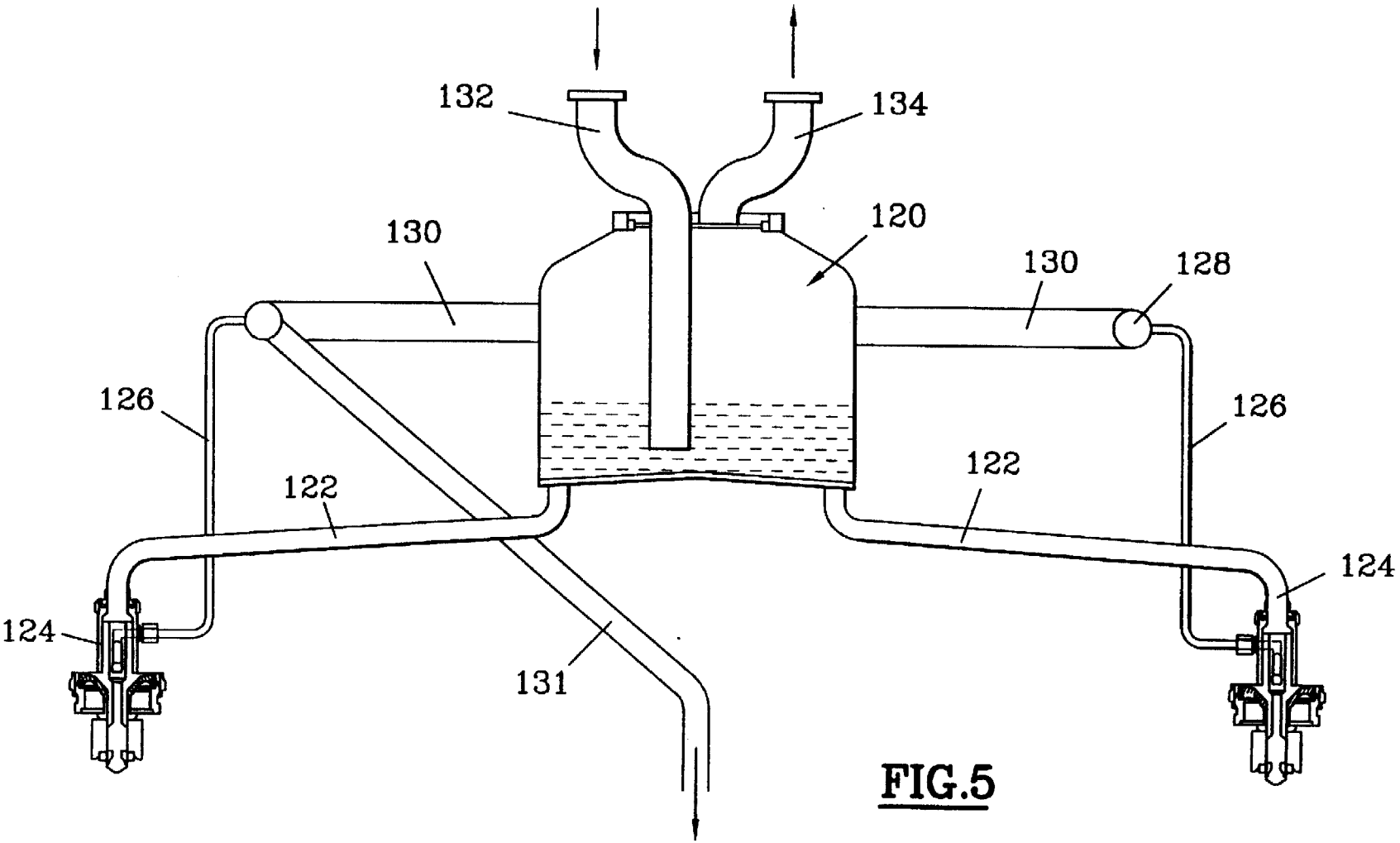
FIG. 5 is a detailed view of the filling carrousel.

A central nozzle 146 coaxial with the ring and equipped with a central suction pipe 148 is connected to the corresponding overflow pipe 126, whereas the nose is fed by the pipe 122 directly originating from the distribution tank 120 (FIG. 5). This nozzle bears the flow openings 142.

Functioning is as follows: the nose is fully sealed and a bottle is mounted under the nose until the neck is in support on the head 140 of said nose and provokes the rise of the latter around the nozzle freeing the flow openings through which the liquid flows via gravity. At the same time, the air contained in the bottle is evacuated by the escape pipe 148. When the liquid arrives at the extremity of the nozzle at the level of the opening emerging from the pipe 148, the liquid is sucked up which results in an extremely precise leveling.

This mode of operation is able to suck up the air from the bottle and remove it outside the filling zone and more generally from the white room. Similarly, the contact of the liquid with the air is reduced to a minimum.

Figures 6A, 6B, 6C:
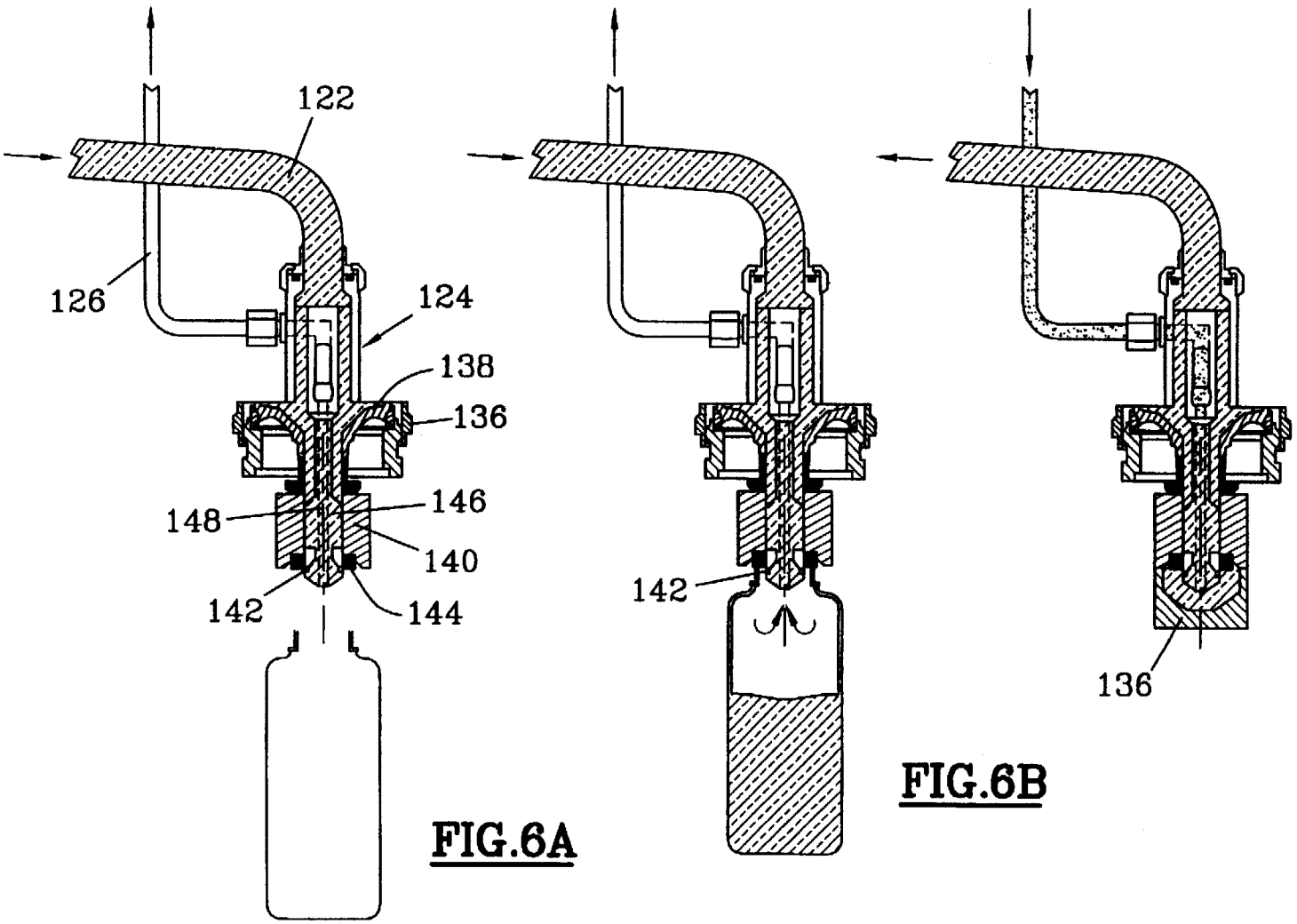
FIGS. 6A, 6B and 6C are views of the filling synoptic with a nose of the bottle filling machine.

FIG. 6C shows a bucket 136 for cleaning and sterilizing the head and more generally the nose by a closed circulation.

The bottle under the carrousel is filled with liquid.

The filled bottles are transferred with the aid of a star 150, the rendering inert phase taking place during this transfer.

The diameter of the transfer star 15 is large enough to reduce the speed of rotation despite the high rates so as to reduce centrifugal force and the risks of overflowing, upturning and splashes.

According to the invention, the rendering inert process is effected by degassing the nitrogen dissolved in the liquid during the saturation step. This nitrogen degassing allows for an accumulation in the neck zone free from liquid.

Figure 7:
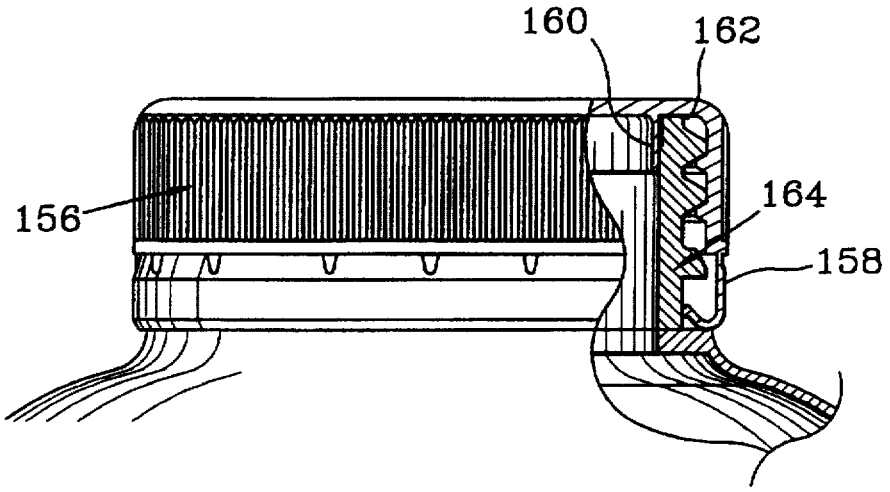
FIG. 7 is a view of a bottle neck with its stopper after closing.

The bottle is then stoppered with a suitable stopper shown on FIG. 7, the stoppering/draining station having the reference 152. This stopper shall have previously undergone a treatment identical to the bottle treatment, namely a washing with ozonic water followed by a rinsing and drying in sterile air 100 so as to eliminate any possible traces of ozone.

This treatment is carried out when the stoppers pass into the conveyor chute 101.

The stoppers are conveyed via gravity into the feed ramp 101 so as to be distributed one by one to the heads of the automatic screwdriver 152 by means of a double star 154. This double star 154 thus ensures the transfer of the stoppered bottles at the outlet of the automatic screwdriver 152 to the conveyor 112 extended by the outlet conveyor 104.

The machine of the screwing station needs to be adapted from the point of accessibility, maintenance and greasing so as to obtain the sought-after ultra-cleanliness.

Once the stopper is screwed in, the stages of the method are ended and the bottle can be removed by the conveyor 112.

The stopper 156 shown on FIG. 7 includes a known type of impregnable ring 158 and lips 160 and 162 which reinforce the impervious qualities of plating the top of the bottle neck with the bottom of the stopper.

The method of the invention is able to:

firstly treat the liquid by means of air removal and nitrogen saturation which has the effect of improving stability of the product and the control of the stiffness of the container, and secondly treating the bottle and stopper with ozone which has the effect of disinfecting said elements and leaving no traces of zone.

The method is particularly advantageous for an application for plastic bottles filled with fruit juice, but is nevertheless fully applicable to glass containers and the bottling of other food liquids which need to be conditioned ultra-clean and cold.

The method of the invention offers a wide range of applications as, in addition to allowing quality conditionings for new commercially-available containers, it also makes it possible to condition liquids in well known containers, such as glass bottles.

What is claimed is:

1. Device for filling plastic bottles with a liquid wherein it includes:

a station for removing air from the liquid, a flash pasteurization station, a station for saturating the liquid with an gas which is inert with respect to the liquid, a station for washing the bottles and stoppers with a liquid disinfectant under a hood in a treated atmosphere, a station for filling the bottles, preferably by means of gravity, under a slight partial vacuum, and a station for degassing the inert gas, and a stoppering station.

2. Device for filling plastic bottles with a liquid according to claim 1, wherein the bottle and stopper washing station is an ozonic water washing station.

3. Device for filling plastic bottles with a liquid according to claim 1, wherein the air removal station includes a vat with vacuuming means.

4. Device for filling plastic bottles with a liquid according to claim 1, wherein the liquid saturation station includes a vat pressurized with a neutral gas with respect to the liquid from a source for this gas equipped with a pressure reducing valve and means for pulverizing the liquid in said vat.

5. Device for filling plastic bottles with a liquid according to claim 1, wherein the bottle washing station includes means for projecting ozonic water onto the internal and external walls of the bottles and means for drying under the hood with extraction of the freed ozone.

6. Device for filling plastic bottles with liquid according to claim 1, wherein the bottle filling station includes a feed circuit with a distributor tank distribution arms, noses functioning under a slight vacuum connected to these arms, and a suction circuit independent of the feed circuit.

7. Device for filling plastic bottles with liquid according to claim 6, wherein the distributor tank has small dimensions and wherein the distribution arms are mounted radiating so as to disturb as little as possible the laminar flow and limit the liquid exchange surface.

8. Device for filling plastic bottles with a liquid according to claim 6, wherein the distributor tank includes a liquid admission intake fitted with a sterile air intake to permit flowing via gravity.

* * * * *